US006227987B1

(12) United States Patent
Kato

(10) Patent No.: US 6,227,987 B1
(45) Date of Patent: May 8, 2001

(54) THREAD WOUND GOLF BALL

(75) Inventor: Akira Kato, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/316,041

(22) Filed: May 21, 1999

(30) Foreign Application Priority Data

May 25, 1998 (JP) ..... 10-142711

(51) Int. Cl.[7] ..... A63B 37/04; A63B 37/06

(52) U.S. Cl. ..... 473/373; 473/361; 473/362; 473/363; 473/364; 473/365; 473/357; 473/359; 473/373; 473/376

(58) Field of Search ..... 473/361–365, 473/357, 359, 373, 376

(56) References Cited

U.S. PATENT DOCUMENTS 5,772,531 * 6/1998 Ohsumi ..... 473/376
5,779,562 * 7/1998 Melvin ..... 473/373
5,797,808 8/1998 Hayashi et al. .
5,816,937 * 10/1998 Shimosaka ..... 473/354
5,816,942 10/1998 Hayashi et al. .
5,885,172 * 3/1999 Herbert ..... 473/354
6,054,550 * 4/2000 Umezawa ..... 528/76

FOREIGN PATENT DOCUMENTS 2317834A 4/1998 (GB) .
9253236 9/1997 (JP) .

* cited by examiner

*Primary Examiner*—Stephen F. Gerrity
*Assistant Examiner*—Paul D. Kim
(74) *Attorney, Agent, or Firm*—Birch, Stewart, Kolasch & Birch, LLP

(57) ABSTRACT

The present invention provides a thread wound golf ball having long flight distance, and high spin amount and excellent controllability when hitting by a short iron club, while keeping the characteristics inherent to the conventional thread wound golf ball, i.e. good shot feel. The present invention related to a thread wound golf ball comprising (a) a solid center composed of an inner center and a center outer layer formed on the inner center, (b) a thread rubber layer formed on the solid center, and (c) a cover covering the thread rubber layer, wherein the inner center has a diameter of 29 to 35 mm and a center hardness in JIS-C hardness of 30 to 70, the center outer layer has a JIS-C hardness of 70 to 90, the solid center has a diameter of 30 to 38 mm, and the cover is formed from thermoplastic resin having a Shore D hardness of 40 to 60.

8 Claims, 1 Drawing Sheet

THREAD WOUND GOLF BALL

FIELD OF THE INVENTION

The present invention relates to a thread wound golf ball. More particularly, it relates to a thread wound golf ball having long flight distance, and high spin amount and excellent controllability when hit by a short iron club, while keeping the characteristics inherent to the conventional thread wound golf ball, i.e. good shot feel.

BACKGROUND OF THE INVENTION

Many golf balls are commercially selling, but they are typically classified into solid golf balls such as two-piece golf ball, three-piece golf ball and the like, and thread wound golf balls. The solid golf ball consists of a solid core of molded rubber material and a cover of thermoplastic resin (e.g. ionomer resin) covering on the solid core. The thread wound golf ball consists of a solid or liquid center, a thread wound layer formed on the center and a cover of ionomer resin or balata etc. having a thickness of 1 to 2 mm covering on the thread wound layer.

The thread wound golf ball, when compared with the solid golf ball, has better shot feel at the time of hitting and better controllability at approach shot. The thread wound golf ball is generally approved of or employed by high level golfers, especially professional golfers, who regard the characteristics of the thread wound golf balls as most important. On the other hand, the thread wound golf ball is inferior in flight distance to the solid golf ball. Therefore, it is required to provide the thread wound golf ball having sufficient flight distance, while keeping the advantage of having good shot feel and excellent controllability.

In the thread wound golf balls, there are two types, such as one comprising a solid center formed from integrally molded rubber material and the other comprising a liquid center composed of a hollow rubber sphere and liquid encapsulated in the sphere. The thread wound golf ball comprising the solid center has the advantage of having no deterioration of performance depending on temperature change, although the thread wound golf ball comprising the liquid center has poor rebound characteristics at low temperature.

Japanese Patent Kokai Publication No. 253236/1997 suggests that a thread wound golf ball comprises a solid center of two-layer structure composed of an inner center and an outer center. The inner center has a Shore D hardness of 10 to 35 and a diameter of 18 to 28 mm, the outer center has a Shore D hardness of 36 to 63, the hardness of the outer center is larger than that of the inner center by not less than 5, and the solid center has a diameter of 29 to 39.5 mm. The thread wound golf ball has short flight distance, because the diameter of the inner center is small and spin amount is high. The thread wound golf ball has poor shot feel, because a thickness of the outer center having high hardness is large.

OBJECTS OF THE INVENTION

A main object of the present invention is to provide a thread wound golf ball having long flight distance, while keeping the characteristics inherent to the conventional thread wound golf ball, i.e. good shot feel and excellent controllability.

According to the present invention, the object described above has been accomplished by employing a thread wound core which comprises a solid center composed of an inner center and a center outer layer, and a thread rubber layer formed on the solid center, and adjusting a diameter of the inner center and the solid center, a center hardness of the inner center, a hardness of the center outer layer and a hardness of thermoplastic resin for forming the cover to a specified range, thereby providing a thread wound golf ball having long flight distance, while keeping the characteristics inherent to the conventional thread wound golf ball, i.e. good shot feel and excellent controllability.

This object as well as other objects and advantages of the present invention will become apparent to those skilled in the art from the following description with reference to the accompanying drawings.

SUMMARY OF THE INVENTION

Figure 1:
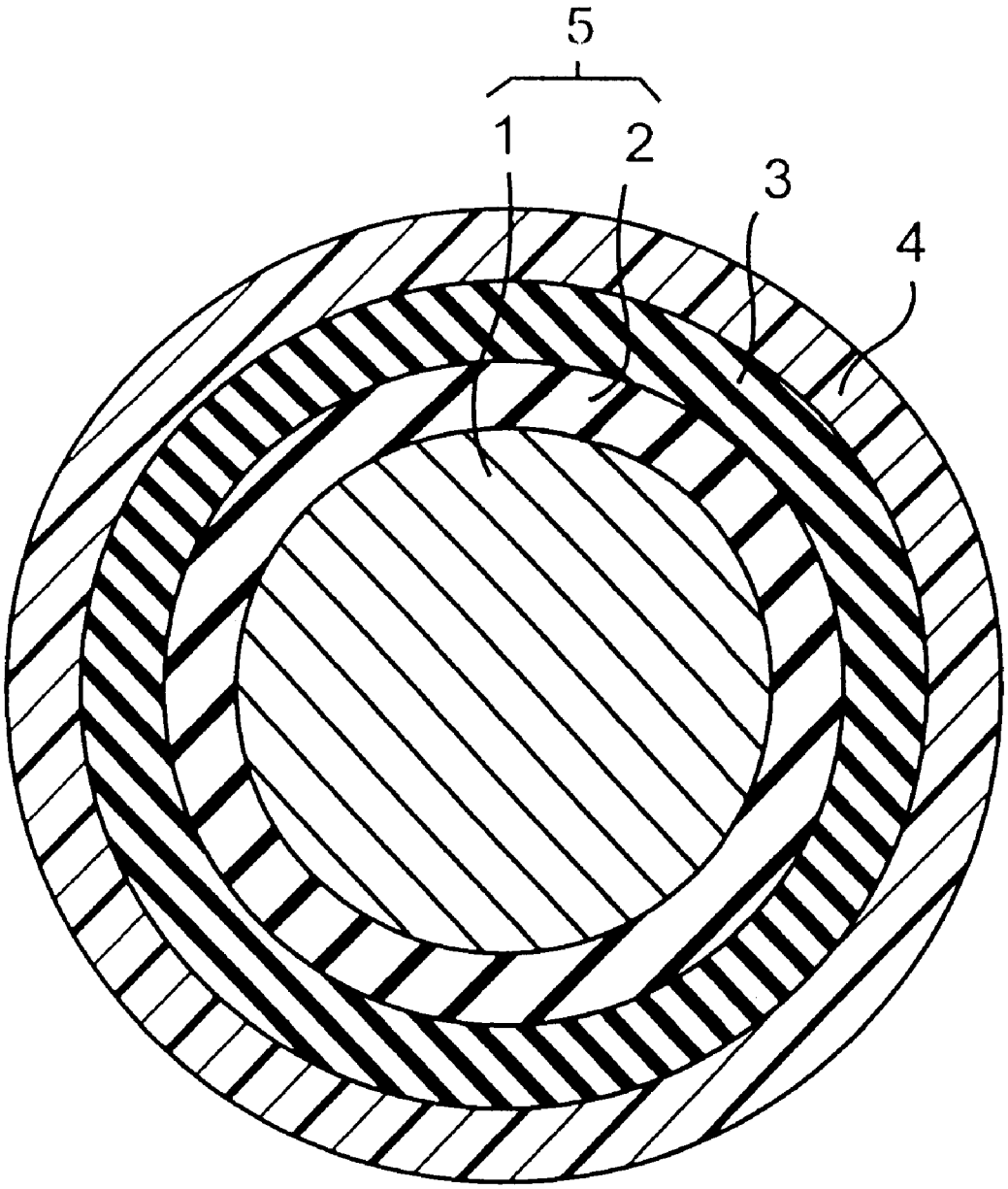
FIG. 1 is a schematic cross section illustrating one embodiment of the golf ball of the present invention.

The present invention provides a thread wound golf ball comprising (a) a solid center composed of an inner center and a center outer layer formed on the inner center, (b) a thread rubber layer formed on the solid center, and (c) a cover covering the thread rubber layer, wherein the inner center has a diameter of 29 to 35 mm and a center hardness in JIS-C hardness of 30 to 70, the center outer layer has a JIS-C hardness of 70 to 90, the solid center has a diameter of 30 to 38 mm, and the cover is formed from thermoplastic resin having a Shore D hardness of 40 to 60.

DETAILED DESCRIPTION OF THE INVENTION

The thread wound golf ball of the present invention will be explained with reference to the accompanying drawing. FIG. 1 is a schematic cross section illustrating one embodiment of the golf ball of the present invention. As shown in FIG. 1, the golf ball of the present invention comprises a solid center 5 which is composed of an inner center 1 and a center outer layer 2, a thread rubber layer 3 and a cover 4 formed on the thread rubber layer 3. The inner center 1 and the center outer layer 2 will be explained together, because the both are formed from the same material. The both are formed from a rubber composition comprising a base rubber, a co-crosslinking agent, an organic peroxide and optionally a filler.

The base rubber may be natural rubber and/or synthetic rubber, which has been conventionally used for solid golf balls. Preferred is high-cis polybutadiene rubber containing a cis-1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

The co-crosslinking agent may be a metal salt of α,β-unsaturated carboxylic acid, particularly mono- or di-valent metal salts, such as zinc or magnesium salts of α,β-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. An amount of the co-crosslinking agent may be 5 to 26 parts by weight, preferably 8 to 25 parts by weight in the inner center 1, and 26 to 40 parts by weight, preferably 27 to 35 parts by weight in the center outer layer 2, based on 100 parts by weight of the base rubber. When the amount of the co-crosslinking agent is larger than 26 parts by weight in the inner center 1, or 40 parts by weight in the center outer layer 2, the center is too hard, and shot feel is poor. On the other hand, when the amount of the co-crosslinking agent is smaller than 5 parts by weight in the inner center 1, or 26 parts by weight in the center outer layer 2, the center is soft. Therefore, rebound characteristics are degraded to reduce flight distance.

The crosslinking agents may be an organic peroxide such as dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. Preferred organic peroxide is dicumyl peroxide. An amount of the organic peroxide is not limited, but may be from 0.5 to 2.0 parts by weight, preferably 0.8 to 1.5 parts by weight, based on 100 parts by weight of the base rubber. When the amount of the organic peroxide is smaller than 0.5 parts by weight, the center is too soft. Therefore, rebound characteristics are degraded to reduce flight distance. On the other hand, when the amount of the organic peroxide is larger than 2.0 parts by weight, the center is too hard, and shot feel is poor.

The filler, which can be used for the core of the golf ball, includes for example, inorganic filler (such as zinc oxide, barium sulfate, calcium carbonate, and the like), high specific gravity metal powder filler (such as tungsten powder, molybdenum powder, and the like), and the mixture thereof. An amount of the filler is not limited and can vary depending on the specific gravity and size of the center, the thread rubber layer and the cover, but may be from 20 to 70 parts by weight, preferably 30 to 65 parts by weight, based on 100 parts by weight of the base rubber. When the amount of the filler is smaller than 20 parts by weight, the center is too light, and the resulting golf ball is too light. On the other hand, when the amount of the filler is larger than 70 parts by weight, the center is too heavy and the resulting golf ball is too heavy.

The rubber composition for the inner center and the center outer layer of the present invention can contain other components, which have been conventionally used for preparing the core of solid golf balls, such as antioxidant or peptizing agent. If used, an amount of the antioxidant is preferably 0.2 to 0.5 parts by weight based on 100 parts by weight of the base rubber.

The inner center 1 is obtained by mixing the rubber composition in an internal mixer (a Banbury mixer or a kneader), or a mixing roll, followed by vulcanizing or press-molding the rubber composition in a mold. In the thread wound golf ball of the present invention, the inner center 1 has a diameter of 29 to 35 mm, preferably 30 to 34 mm. When the diameter of the inner center is smaller than 29 mm, launch angle at the time of hitting reduces, so that spin amount increases and flight distance reduces. On the other hand, when the diameter of the inner center is larger than 35 mm, the center outer layer is too thin. Therefore, rebound characteristics as the technical effects of the center outer layer do not sufficiently exhibit to reduce flight distance.

The inner center has a center hardness in JIS-C hardness of 30 to 70, preferably 40 to 65. The JIS-C hardness is substantially the same as Shore C hardness. When the hardness is smaller than 30, rebound characteristics of the resulting golf ball are degraded and flight distance reduces. When the hardness is larger than 70, spin amount increases and flight distance reduces, thus degrading shot feel. The term "center hardness of an inner center" as used herein refers to the hardness, which is obtained by cutting the inner center into two equal parts and then measuring a hardness at center point. The center outer layer 2 is then formed on the inner center 1.

The center outer layer of the present invention may be formed by conventional methods, which have been known to the art and used for the cover of the golf balls. For example, there can be used a method comprising molding the center outer layer composition into a semi-spherical half-shell, covering the inner center with the two of the half-shells, followed by pressure molding, or a method comprising injection molding the center outer layer composition directly on the inner center to cover it. As described above, the center outer layer 2 is formed on the inner center 1 to obtain the solid center 5.

In the golf ball of the present invention, the center outer layer has a JIS-C hardness of 70 to 90, preferably 72 to 85. When the hardness is smaller than 70, the resulting golf ball is too soft, and desired shot feel is not obtained. On the other hand, when the hardness is larger than 90, the resulting golf ball is too hard, and shot feel is hard and poor. The solid center of the golf ball of the present invention has a diameter of 30 to 38 mm, preferably 31 to 37 mm. When the diameter is smaller than 30 mm, spin amount of the resulting golf ball increases and flight distance reduces. On the other hand, when the diameter is larger than 38 mm, the thread rubber layer is too thin. Therefore, rebound characteristics as the technical effects of the thread rubber layer do not sufficiently exhibit and flight distance reduces.

Molding the solid center within the ranges described above can be conducted by adjusting the formulation of the inner center and the center outer layer. That is, it can be conducted by adjusting an amount of the co-crosslinking agent so that the amount in the center outer layer is larger than that in the inner center. JIS-C hardness difference between the center outer layer and a center point of the inner center is from 5 to 60, preferably 10 to 55. The thread rubber layer 3 is then formed on the solid center 5.

The thread rubber wound on the solid center 5 can be the same one as that which has been conventionally used in the thread rubber layer of the thread wound golf balls. For example, the thread rubber can be one that is obtained by vulcanizing a rubber composition prepared by formulating sulfur, a vulcanization accelerator, a vulcanization aid, an antioxidant and the like to a natural rubber or a blend rubber of the natural rubber and a synthetic polyisoprene. The thread rubber is wound on the solid center by conventional methods which have used for the thread wound core of the thread wound golf balls. The thread rubber layer 3 has a thickness of 1.0 to 5.0 mm, preferably 1.2 to 4.5 mm. When the thickness of the thread rubber layer is smaller than 1.0 mm, the thread rubber layer is too thin to exhibit sufficient impact relaxation, and shot feel is poor. On the other hand, when the thickness is larger than 5.0 mm, the spin amount at the time of hitting increases and flight distance reduces. The cover 4 is then formed on the thread rubber layer 3.

The cover of the present invention is formed from a thermoplastic resin, particularly an ionomer resin, which is known to the art and has been used for the cover of golf balls. The ionomer resin used in the present invention is not limited, but includes a copolymer of $\alpha$-olefin and $\alpha,\beta$-unsaturated carboxylic acid having 3 to 8 carbon atoms, of which a portion of carboxylic acid groups is neutralized with metal ion, or mixtures thereof. The $\alpha$-olefin in the ionomer is preferably ethylene or propylene, and the $\alpha,\beta$-unsaturated carboxylic acid is preferably acrylic acid or methacrylic acid. The metal ion which neutralizes a portion of carboxylic acid groups of the copolymer includes alkaline metal ion, such as sodium ion, potassium ion, lithium ion and the like; divalent metal ion, such as zinc ion, calcium ion, magnesium ion, and the like; trivalent metal ion, such as aluminum ion, neodymium ion, and the like; and the mixture thereof. Preferred are sodium ion, zinc ion, lithium ion and the like, in view of rebound characteristics, durability and the like. The ionomer resin is not limited, but examples thereof will be shown by trade names. Examples of the ionomer resin, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resin, which is commercially available from Du Pont Co., include Surlyn AD8511, Surlyn AD8512 and the like. Examples of the ionomer resin, which is commercially available from Exxon Chemical Co., include Iotek 7010, Iotek 8000, and the like. These ionomer resins are used alone or in combination.

As the materials used in the cover of the present invention, the above ionomer resin may be used alone, but the ionomer resin may be suitably used in combination with a specific elastomer or resin. Examples of the combinations thereof include:

(i) a heat mixture of an ionomer resin, an acid-modified thermoplastic elastomer or thermoplastic elastomer having terminal OH groups, and an SBS (styrene-butadiene-styrene) block copolymer having polybutadiene portion with epoxy groups or SIS (styrene-isoprene-styrene) block copolymer having polyisoprene portion with epoxy groups, (ii) a heat mixture of an ionomer and a terpolymer of ethylene-unsaturated carboxylic acid ester-unsaturated carboxylic acid, (iii) a heat mixture of an ionomer, a maleic anhydride-modified thermoplastic elastomer and a glycidyl group-modified thermoplastic elastomer.

The cover is formed from thermoplastic resin having a Shore D hardness of 40 to 60, preferably 43 to 58, more preferably 45 to 56. When the hardness is smaller than 40, the cover is too soft, and rebound characteristics of the resulting golf ball are degraded. On the other hand, when the hardness is larger than 60, spin amount at the time of hitting by a short iron club decreases.

In the golf ball of the present invention, the resin composition for the cover may optionally contain fillers (such as barium sulfate, etc.), pigments (such as titanium dioxide, etc.), and the other additives (such as a dispersant, an antioxidant, a UV absorber, a photostabilizer and a fluorescent agent or a fluorescent brightener, etc.), in addition to the resin component, as long as the addition of the additives does not deteriorate the desired performance of the golf ball cover, but an amount of the pigment is preferably from 1.0 to 6.0 parts by weight based on 100 parts by weight of the cover resin.

The cover of the present invention may be formed by conventional methods, which have been known to the art and used for forming the cover of the golf balls. For example, there can be used a method comprising molding the cover composition into a semi-spherical half-shell in advance, covering the thread wound core with the two half-shells, followed by pressure molding at 130 to 170° C. for 1 to 5 minutes, or a method comprising injection molding the cover composition directly on the thread wound core to cover it. The cover preferably has a thickness of 1.0 to 3.0 mm, more preferably 1.2 to 2.5 mm. When the thickness of the cover is smaller than 1.0 mm, the cover is too thin to exhibit sufficient rebound characteristics of the thread rubber layer, and the cover is easy to break when repeatedly hitting. On the other hand, when the thickness is larger than 3.0 mm, shot feel is poor.

At the time of cover molding, many depressions called "dimples" may be optionally formed on the surface of the golf ball. Furthermore, paint finishing or marking stamp may be optionally provided after cover molding for serving commercial sells.

EXAMPLES

The following Examples and Comparative Examples further illustrate the present invention in detail but are not to be construed to limit the scope of the present invention.

Production of Inner Center

Each inner center was obtained by mixing the rubber composition for the inner center having the formulation shown in Table 1 and press-molding the mixture at 160° C. for 20 minutes. A diameter and center hardness in JIS-C hardness of the resulting inner center were measured, and the results are shown in the same Table.

TABLE 1

| | (parts by weight) | | | | | | |
|---|---|---|---|---|---|---|---|
| Inner center | Example No. | | | Comparative Example No. | | | |
| composition | 1 | 2 | 3 | 1 | 2 | 3 | 4 |
| BR11 *1 | 100 | 100 | 100 | 100 | 100 | 100 | 100 |
| Zinc acrylate | 15 | 10 | 15 | 15 | 15 | 27 | 3 |
| Zinc oxide | 15 | 15 | 15 | 15 | 15 | 15 | 15 |
| Antioxidant *2 | 0.5 | 0.5 | 0.5 | 0.5 | 0.5 | 0.5 | 0.5 |
| Dicumyl peroxide | 1.2 | 1.2 | 1.2 | 1.2 | 1.2 | 1.2 | 1.2 |
| Barium sulfate | 39.1 | 35.0 | 27.4 | 39.1 | 22.7 | 35.9 | 42.3 |
| Diameter (mm) | 30.0 | 30.0 | 32.0 | 27.0 | 36.0 | 30.0 | 30.0 |
| Center hardness (JIS-C) | 50 | 40 | 50 | 50 | 50 | 75 | 20 |

Production of Solid Center

The rubber compositions for center outer layer having formulations shown in Table 2 were molded in semi-spherical half-shells, encapsuling the above inner center with the two half-shells, followed by press-molding in the mold at 160° C. for 20 minutes to obtain solid center. A diameter and JIS-C hardness of the resulting solid center were measured, and the results are shown in the same Table.

TABLE 2

| | (parts by weight) | | | | | | |
|---|---|---|---|---|---|---|---|
| Center outer layer | Example No. | | | Comparative Example No. | | | |
| composition | 1 | 2 | 3 | 1 | 2 | 3 | 4 |
| BR11 *1 | 100 | 100 | 100 | 100 | 100 | 100 | 100 |
| Zinc acrylate | 27 | 30 | 30 | 27 | 30 | 30 | 35 |
| Zinc oxide | 15 | 15 | 15 | 15 | 15 | 15 | 15 |
| Antioxidant *2 | 0.5 | 0.5 | 0.5 | 0.5 | 0.5 | 0.5 | 0.5 |
| Dicumyl peroxide | 1.2 | 1.2 | 1.2 | 1.2 | 1.2 | 1.2 | 1.2 |
| Barium sulfate | 35.9 | 29.2 | 22.6 | 35.9 | 17.7 | 35.1 | 33.7 |

TABLE 2-continued

| Center outer layer composition | (parts by weight) Example No. 1 | 2 | 3 | Comparative Example No. 1 | 2 | 3 | 4 |
|---|---|---|---|---|---|---|---|
| Diameter (mm) | 34.0 | 35.0 | 36.0 | 34.0 | 37.0 | 34.0 | 34.0 |
| JIS-C hardness | 75 | 80 | 80 | 75 | 80 | 80 | 85 |

*1: High-cis polybutadiene (trade name "BR11") from JSR Co., Ltd., Content of 1,4-cis-polybutadiene: 96%
*2: Antioxidant (trade name "Noclac NS-6") 2,5-di-t-butylhydroquinone from Ouchi Shinko Kagaku Kogyo Co., Ltd.

Formation of Thread Rubber Layer

Each thread rubber layer was then formed on the solid center by winding the thread rubber. The thread rubber was prepared from a blend of natural rubber and a low cis-isoprene rubber ("Shell IR-309" commercially available from Shell Chemical Co., Ltd.)=50/50 (weight ratio). A diameter after winding the thread rubber was about 39.0 mm.

Preparation of Cover Composition

The formulation materials shown in Table 3 were mixed using a kneading type twin-screw extruder to obtain pelletized cover compositions. The extrusion condition were a screw diameter of 45 mm, a screw speed of 200 rpm, and a screw L/D of 35.

The formulation materials were heated at 200 to 260° C. at the die position of the extruder. The Shore D hardness and flexural modulus of the resulting cover compositions were also shown in the same Table. The flexural modulus was determined according to ASTM D-747, using a sample of a heat and press molded sheet having a thickness of about 2 mm from each composition, which had been stored at 23° C. for 2 weeks. The Shore D hardness was determined according to ASTM D-2240, using a sample of a stack of the three or more sheets described above.

TABLE 3

| Cover composition | (parts by weight) A | B | C |
|---|---|---|---|
| Hi-milan 1605 *3 | — | — | 15 |
| Hi-milan 1706 *4 | — | — | 15 |
| Hi-milan 1855 *5 | 20 | — | 70 |
| Surlyn AD8511 *6 | 25 | 25 | |
| Surlyn AD8512 *7 | 25 | 25 | |
| Taftek Z514 *8 | 20 | — | |
| Bondine AX8390 *9 | 10 | — | |
| ESB AT1010 *10 | — | 15 | |
| HG-252 *11 | — | 35 | |
| Barium sulfate | 2 | 2 | 2 |
| Titanium dioxide | 2 | 2 | 2 |
| Cover Shore D hardness | 54 | 52 | 55 |
| Flexural modulus (MPa) | 135 | 110 | 150 |

*3: Hi-milan 1605 (trade name), ethylene-methacrylic acid copolymer ionomer resin obtained by neutralizing with sodium ion, manufactured by Mitsui Du Pont Polychemical Co., Ltd., MI = 2.8, flexural modulus = about 310 MPa TABLE 3-continued

| Cover composition | (parts by weight) A | B | C |
|---|---|---|---|

*4: Hi-milan 1706 (trade name), ethylene-methacrylic acid copolymer ionomer resin obtained by neutralizing with zinc ion, manufactured by Mitsui Du Pont Polychemical Co., Ltd., MI = 0.8, flexural modulus = about 260 MPa
*5: Hi-milan 1855 (trade name), ethylene-butyl acrylate-methacrylic acid terpolymer ionomer resin obtained by neutralizing with zinc ion, manufactured by Mitsui Du Pont Polychemical Co., Ltd., MI = 1.0, flexural modulus = about 90 MPa
*6: Surlyn AD8511 (trade name), ethylene-methacrylic acid copolymer ionomer resin obtained by neutralizing with zinc ion, manufactured by Du Pont Co., MI = 3.4, flexural modulus = about 220 MPa
*7: Surlyn AD8512 (trade name), ethylene-methacrylic acid copolymer ionomer resin obtained by neutralizing with sodium ion, manufactured by Du Pont Co., MI = 4.4, flexural modulus = about 280 MPa
*8: Taftek Z514 (trade name), glycidyl methacrylate adduct of hydrogenated styrene-butadiene-styrene block copolymer, manufactured by Asahi Kasei Kogyo Co., Ltd., JIS-A hardness = 65, content of styrene = about 20% by weight, content of hydrogenated butadiene = about 80% by weight, content of glycidyl methacrylate = about 1% by weight
*9: Bondine AX8390 (trade name), ethylene-ethyl acrylate-maleic anhydride terpolymer resin, manufactured by Sumitomo Chemical Industries Co., Lyd., MI = 7.0, Shore D hardness = 14, content of ethyl acrylate + maleic anhydride = 32% (content of maleic anhydride:1 to 4%)
*10: ESB AT1010 (trade name), styrene-butadiene-styrene structure block copolymer having a polybutadiene block with epoxy groups, manufactured by Daicel Chemical Industries, Ltd., styrene/butadiene (weight ratio) = 40/60, JIS-A hardness = 67, content of epoxy: about 1.5 to 1.7% by weight
*11: HG-252 (trade name), hydrogenated styrene-isoprene-styrene block copolymer having a terminal OH group, manufactured by Kuraray Co. Ltd., JIS-A hardness = 80, content of styrene = about 40% by weight

(Examples 1 to 3 and Comparative Examples 1 to 4)

The resulting cover compositions were molded into semi-spherical half-shells, encapsuling the resulting thread wound core with the two half-shells, followed by press-molding in the mold for golf ball and then coating with a paint to obtain a thread wound golf ball having an outer diameter of 42.8 mm. Flight performance (initial velocity, launch angle, spin amount and carry) and shot feel were measured or evaluated, and the results are shown in Table 4 (Examples) and Table 5 (Comparative Examples). The test methods are as follows.

Test Method (1) Flight Performance

After a No. 1 wood club (a driver, W#1) was mounted to a swing robot manufactured by True Temper Co. and a golf ball was hit at head speed of 45 m/sec, the initial velocity, launch angle, spin amount and flight distance were measured. The spin amount was measured by continuously taking a photograph of a mark provided on the hit golf ball using a high-speed camera. As the flight distance, carry which was a distance to the firstly dropping point on the ground was measured.

After a No. 9 iron club (I#9) was mounted to a swing robot manufactured by True Temper Co. and a golf ball was hit at head speed of 34 m/sec, spin amount was measured as described above.

(2) Shot Feel

The shot feel of the golf ball was evaluated by 10 top professional golfers according to a practical hitting test using a No. 1 wood club. The evaluation criteria are as follows. The results shown in the Tables below are based on the fact that not less than 8 out of 10 professional golfers evaluated with the same criteria.

Evaluation criteria:

○: Soft and good

XH: Hard and poor

XS: Too soft and poor

TABLE 4

| Test item | Example No. 1 | 2 | 3 |
|---|---|---|---|
| (Inner center) | | | |
| Diameter (mm) | 30.0 | 30.0 | 32.0 |
| Center hardness (JIS-C) | 50 | 40 | 50 |
| (Center outer layer) JIS-C hardness | 75 | 80 | 80 |
| (Solid center) Diameter (mm) | 34.0 | 35.0 | 36.0 |
| Cover composition | A | B | C |
| (Golf ball) | | | |
| Flight performance (W #1, 45 m/sec) | | | |
| Initial velocity (m/sec) | 64.8 | 64.7 | 64.9 |
| Launch angle (degree) | 13.0 | 12.8 | 13.1 |
| Spin amount (rpm) | 2650 | 2700 | 2620 |
| Carry (yard) | 221.5 | 221.0 | 222.0 |
| Flight performance (I #9, 34 m/sec) | | | |
| Spin amount (rpm) | 8500 | 8650 | 8450 |
| Shot feel | ○ | ○ | ○ |

TABLE 5

| Test item | Comparative Example No. 1 | 2 | 3 | 4 | 5* |
|---|---|---|---|---|---|
| (Inner center) | | | | | |
| Diameter (mm) | 27.0 | 36.0 | 30.0 | 30.0 | — |
| Center hardness (JIS-C) | 50 | 50 | 75 | 20 | — |
| (Center outer layer) JIS-C hardness | 75 | 80 | 80 | 85 | — |
| (Solid center) Diameter (mm) | 34.0 | 37.0 | 34.0 | 34.0 | — |
| Cover composition | A | A | A | A | — |
| (Golf ball) | | | | | |
| Flight performance (W #1, 45 m/sec) | | | | | |
| Initial velocity (m/sec) | 64.9 | 63.5 | 65.1 | 63.2 | 64.7 |
| Launch angle (degree) | 12.5 | 13.3 | 11.8 | 13.0 | 12.6 |
| Spin amount (rpm) | 2930 | 2580 | 3050 | 2600 | 2850 |
| Carry (yard) | 215.5 | 212.0 | 216.0 | 213.5 | 217.0 |
| Flight performance (I #9, 34 m/sec) | | | | | |
| Spin amount (rpm) | 8550 | 8430 | 8580 | 8400 | 8050 |
| Shot feel | XH | XS | XH | XS | ○ |

*Conventional thread wound golf ball, manufactured by Sumitomo Rubber Industries, Ltd.

As is apparent from Table 4 and Table 5, the golf balls of Examples 1 to 3 had longer flight distance than the conventional thread wound golf ball of Comparative Example 5, and soft and good shot feel which evaluated by top professional golfers.

To the contrary, the golf ball of Comparative Example 1 has large spin amount, and thus the golf ball creates blown-up trajectory when hitting and flight distance reduces, because the diameter of the inner center is too small.

The golf ball of Comparative Example 2 has short flight distance, because the diameter of the inner center is too large and thus the thickness of the center outer layer is too thin to sufficiently exhibit rebound characteristics.

The golf ball of Comparative Example 3 has large spin amount, and thus the golf ball creates blown-up trajectory when hitting, and flight distance reduces, because the center hardness of the inner center is too large.

In the golf ball of Comparative Example 4, rebound characteristics are degraded to reduce flight distance, because the center hardness of the inner center is too small.

What is claimed is:

1. A thread wound golf ball, comprising:

(a) a solid center composed of an inner center and a center outer layer formed on the inner center, (b) a thread rubber layer formed on the solid center, and (c) a cover covering the thread rubber layer, wherein the inner center has a diameter of 29 to 35 mm and a center hardness in JIS-C hardness of 30 to 70, the center outer layer has a JIS-C hardness of 70 to 90, the hardness difference between the center outer layer and the center point of the inner center being from 5 to 60, the solid center has a diameter of 30 to 38 mm and is formed from a rubber composition comprising polybutadiene rubber containing not less than 40% of a cis- 1,4 bond, a metal salt of a α,β-unsaturated carboxylic acid and an organic peroxide, and the cover is formed from thermoplastic resin having a Shore D hardness of 40 to 60.

2. The thread wound golf ball according to claim 1, wherein the thread rubber layer has a thickness of 1.0 to 5.0 mm.

3. The thread wound golf ball according to claim 1, wherein the cover has a thickness of 1.0 to 3.0 mm.

4. The thread wound golf ball according to claim 1, wherein the polybutadiene rubber contains not less than 80% of a cis-1,4 bond.

5. The thread wound golf ball according to claim 1, wherein the polybutadiene rubber is mixed with natural rubber, polyisoprene rubber, styrene-butadiene rubber or ethylene-propylene-diene rubber.

6. The thread wound golf ball according to claim 1, the metal salt of a α,β-unsaturated carboxylic acid is a zinc or magnesium salt of a α,β-unsaturated carboxylic acid having 3 to 8 carbon atoms.

7. The thread wound golf ball according to claim 1, wherein the organic peroxide is dicumyl peroxide, 1,1-bis (t-butylperoxy)-3,3,5-trimethylcyclohexane, 2,5-dimethyl-2,5-di(t-butylperoxy-hexane or di-t-butyl peroxide.

8. Thread wound golf ball according to claim 1, wherein the solid center further comprises a filler.

* * * * *